US005469787A

United States Patent [19]

Turner et al.

[11] Patent Number: 5,469,787

[45] Date of Patent: Nov. 28, 1995

[54] MULTI-COLOR PRINTING PRESS

[75] Inventors: Michael R. Turner, Renton; Leslie L. Miller, Redmond, both of Wash.

[73] Assignee: Heath Custom Press, Inc., Renton, Wash.

[21] Appl. No.: 213,673

[22] Filed: Mar. 15, 1994

[51] Int. Cl.[6] ..... B41M 1/14

[52] U.S. Cl. ..... 101/211; 101/136; 101/152; 101/174; 101/246; 101/177

[58] Field of Search ..... 101/211, 177, 101/246, 247, 232, 216, 183, 184, 185, 172, 174, 181, 490, 151, 152, 153, 136, 137, 141, 142, 246

[56] References Cited

U.S. PATENT DOCUMENTS

| | | | |
|---|---|---|---|
| Re 15,286 | 2/1922 | Schultz et al. . | |
| 517,907 | 4/1894 | Wendte | 101/174 |
| 684,450 | 10/1901 | Mowbray . | |
| 1,065,228 | 6/1913 | Elsworth | 101/175 |
| 1,085,224 | 1/1914 | Roesen . | |
| 1,178,907 | 4/1916 | Firm | 101/177 |
| 1,210,202 | 12/1916 | Pollard | 101/177 |
| 2,003,800 | 6/1935 | Barber | 101/177 |
| 2,054,215 | 9/1936 | Colville | 101/177 |
| 3,247,790 | 4/1966 | Nash | 101/177 |
| 3,384,011 | 5/1968 | Bolza-Schunemann | 101/183 |
| 4,231,291 | 9/1977 | Davidson et al. | 101/137 |
| 4,280,406 | 7/1981 | Corse | 101/177 |
| 4,441,423 | 4/1984 | Germann | 101/211 |
| 4,777,876 | 10/1988 | Ishii | 101/246 |
| 4,833,982 | 5/1989 | Liebert et al. | 101/177 |
| 4,854,232 | 8/1989 | Oda | 101/211 |
| 5,009,156 | 4/1991 | Germann | 101/177 |
| 5,103,257 | 4/1992 | Wijnaendts-Van-Rehsandt | 355/53 |
| 5,237,923 | 8/1993 | Williams et al. | 101/467 |
| 5,249,525 | 10/1993 | Lewis et al. | 101/453 |

FOREIGN PATENT DOCUMENTS

| | | | |
|---|---|---|---|
| 402059 | 9/1924 | Germany . | |
| 432853 | 8/1926 | Germany | 101/137 |
| 3921999 | 1/1990 | Germany | 101/246 |
| 259157 | 10/1926 | United Kingdom . | |
| 2095622 | 10/1982 | United Kingdom | 101/177 |

OTHER PUBLICATIONS

Ryobi 524 High Speed 4–Color Offset Press Brochure Ryobi Limited, 9 pages, Tokyo Head Office 3–15–1 Sotokanada Chiyoda–Ku, Tokyo 101, Japan, Telex J33672; Ryobi, undated "Trident Pack–to–Pack Press"–Rockwell International 7 pages Aug. 1987.

*Primary Examiner*—Eugene H. Eickholt
*Attorney, Agent, or Firm*—Dowrey & Associates

[57] ABSTRACT

A multi-color printing press having a single segmented impression cylinder with multiple, segmented blanket cylinders of equal diameter arranged about the periphery thereof. The segments of the impression cylinder and the blanket cylinders are equal in length and the number of segments on the impression cylinder is equal to the number of segments on the blanket cylinders multiplied by a whole number, plus one additional segment. Each blanket cylinder is provided with a plate cylinder of equal diameter which has the same number of segments. Color rolls provide each segment of the plate cylinder with a different color. Sheets to be printed are fed to the gripping means on the successive segments of the impression cylinder and delivery means removes sheets after printing. Each sheet is held on the impression cylinder for a number of revolutions equal to the number of segments on any one blanket cylinder.

18 Claims, 2 Drawing Sheets

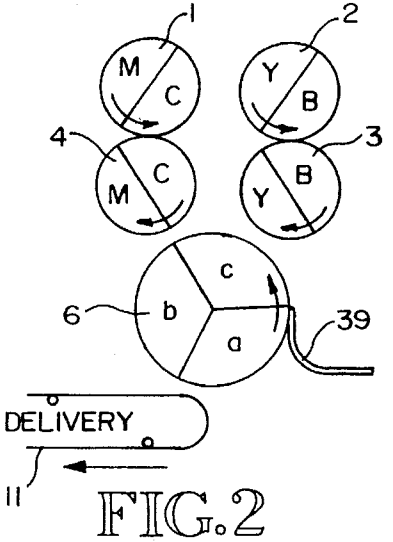
FIG. 2
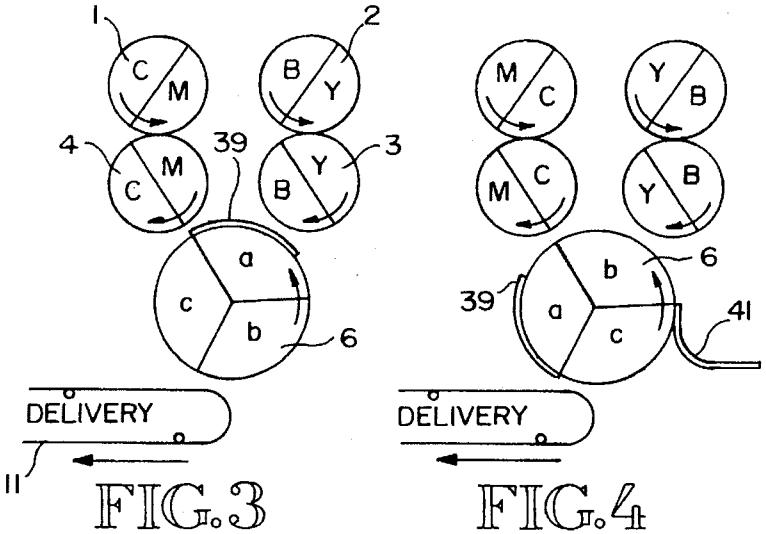
FIG. 3
FIG. 4
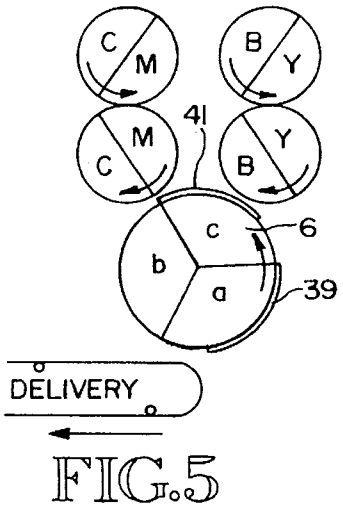
FIG. 5
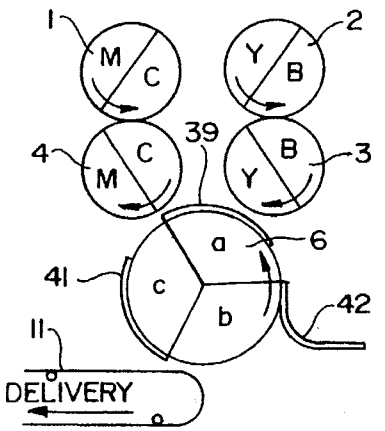
FIG. 6
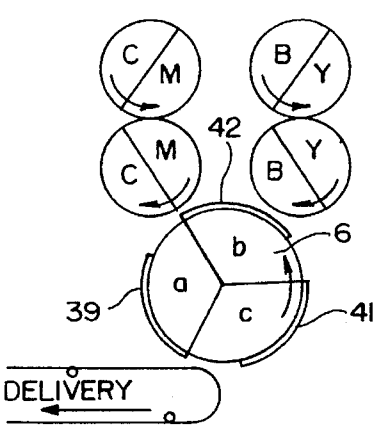
FIG. 7
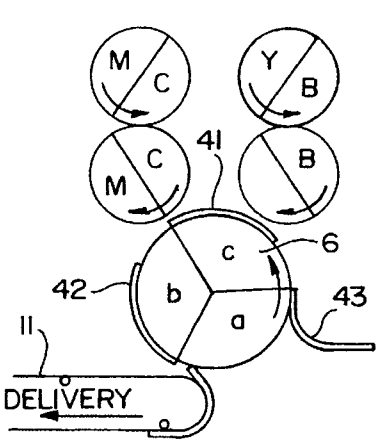
FIG. 8

MULTI-COLOR PRINTING PRESS

BACKGROUND OF THE INVENTION

1. Field of the Invention

The present invention relates-to improvements in rotary offset printing presses for producing recto work by means of several offset units with a common impression cylinder. More particularly, the invention relates to sheet-fed multi-color printing presses of the type described which utilize segmented plate and blanket cylinders with a segmented common impression cylinder.

2. Description of the Prior Art

Prior art printing machines, whether designed for offset printing or direct printing, have been utilized for multi-color printing for many years. Two of the most common difficulties with such machines have been (1) the necessity of multiplying the number of plate and blanket cylinders, along with their associated inking rolls, depending on the number of colors to be printed and (2) the necessity in some systems of depositing multiple, colored inks simultaneously on either the plate or blanket cylinders.

The increase in number of printing cylinders and inking roll systems, of course, greatly increases the size and complexity of the printing press and hence the expense of manufacture and operation. In recent years increased emphasis has been placed on reducing the "foot print" of industrial processing equipment including printing presses of all types.

The problems encountered with depositing multiple colors or "sharing" on a single plate or blanket cylinder surface are well known and involve primarily the tendency of the ink to run or blur so as to lose the definition between colors. Additional problems arise when multiple impression cylinders are utilized or when it otherwise becomes necessary to transfer a sheet to be printed from one gripping mechanism to another. The ability to obtain exact registry becomes increasingly difficult with each gripping action.

The U.S. Pat. No. 1,085,224 to Roesen illustrates an example of an offset printing system wherein multiple blanket cylinders B and multiple plate cylinders C, with their associated dampening and inking mechanisms, are arranged about the periphery of a segmented impression cylinder A. In this arrangement, each plate cylinder C transfers only a single color. The result is a rather complex and expensive printing press. British Patent No. 259157 to Vogtlandische Maschinen Fabrik and the German Patent No. 402059 to Vogtlandische Maschinenfabrik are further examples of complex multi-color printing presses wherein each offset plate and blanket cylinder combination transfers only a single color.

The U.S. Reissue Pat. No. 15286 to Schultz et al and U.S. Pat. No. 684,450 to Mowbray both illustrate examples of multi-color printing presses wherein several different colored inks are applied to a single blanket prior to being transferred to the paper to be printed. In the Schultz et al. patent, for instance, each of the three plate cylinders 1 bears a different color design and all three colors are deposited onto each blanket 9–11 of the cylinder 8 prior to printing onto the paper carried by impression cylinder 15. In the Mowbray patent, a form g or a form-cylinder G receives multi-colored designs from color plates prior to transfer from the form to an impression surface carrying the paper to be printed. This type of multi-color printing often results in color-mingling and defamation of design when moist inks are superimposed.

SUMMARY OF THE INVENTION

The present invention provides an offset printing system for multi-color printing which greatly reduces the number of required offset printing cylinders and which requires only one gripping of the sheet to be printed on the surface of the impression cylinder. The number of colors printed may be easily varied with only one color at a time being transferred from a blanket cylinder to the sheet being printed, With the present invention a plurality of plate cylinders is provided and each plate cylinder is equipped with a single plate having a number of segments, each segment bearing its specific color or design. Since each plate cylinder requires only one plate gripping mechanism and only one plate for two colors, exact registry of the two colors is insured. An associated blanket cylinder of the same diameter is provided with each plate cylinder and has the identical number of segments for receiving the individual color images directly from the segmented plate cylinder. A common segmented impression cylinder grips and holds multiple sheets to be printed.

The common impression cylinder is segmented with the circumferential extent or length of each segment being equal to the circumferential length of a single segment on the blanket cylinders. The number of segments on the impression cylinder equals the number of segments on any blanket cylinder multiplied by any whole number, plus one additional segment. With this arrangement, the sheet to be printed is transferred to the gripper mechanism on a segment of the impression cylinder and remains on the impression cylinder for a number of rotations equal to the number of colors on any one blanket cylinder. Each sheet thus receives one color from each blanket cylinder upon each rotation of the impression cylinder. For a four color printing system, for instance, two plate cylinders and two matching blanket cylinders are provided with each plate and blanket cylinder being divided into two segments, each segment bearing a separate color. A single impression cylinder is provided with three segments, each of which is of the identical circumferential length as any one segment on the plate and blanket cylinders. The sheets are fed alternately, in this case, to the impression cylinder segments and remain gripped on the surface of the impression cylinder during two rotations of the cylinder, i.e. until both colors from both blanket cylinders are printed. The sheets are printed with one color from each blanket cylinder during each rotation. A delivery mechanism then removes each sheet from the impression cylinder in alternate fashion after all four colors are printed.

The present invention will be described as utilizing existing digital controlled electronic imaging technology for imaging the surfaces of the plate cylinder segments in a well known manner. The preferred electronic imaging assembly is a laser imager utilizing a pulsed source of electromagnetic radiation such as that manufactured by Presstek, Inc., Hudson, N.Y. It will be understood, however, that any known plate imaging technology, either on or off press, may be utilized. For instance, conventional waterless printing plates such as those sold by the Toray Company of New York, N.Y. may be utilized. In this case, the printing plates are imaged off of the press and then mounted on the plate cylinder for printing.

BRIEF DESCRIPTION OF THE DRAWINGS

FIGS. 2–8 illustrate the printing cycle of a single sheet through two rotations of the impression cylinder in a four-color printing system.

DESCRIPTION OF THE PREFERRED EMBODIMENT

Figure 1:
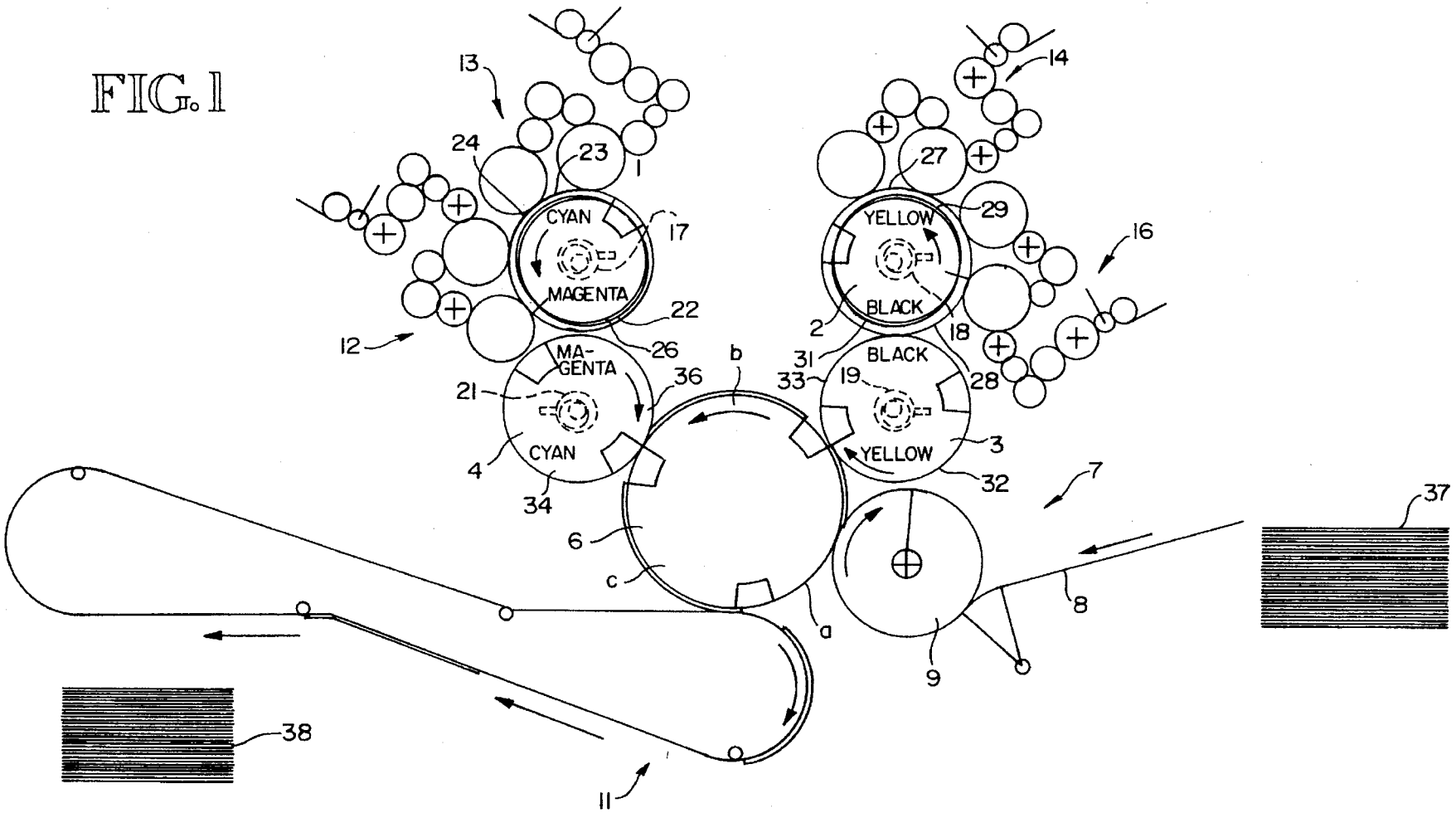
FIG. 1 is a schematic illustration showing the arrangement of printing cylinders and sheet feeding and delivery mechanisms.

For purposes of illustration, the present invention will be described herein relative to a four-color printing system utilizing offset printing methods well known to the art. FIG. 1 shows a system wherein first and second plate cylinders 1 and 2 are mounted so as to cooperate with first and second blanket cylinders 3 and 4 respectively with the blanket cylinders 3 and 4 cooperating with a single impression cylinder 6 in a manner presently to be described. The system also includes a sheet feeding mechanism indicated generally at 7 which includes a sheet conveyor 8 and a transfer cylinder 9. The printed sheets are removed from the impression cylinder 6 after printing by means of the sheet delivery system indicated at 11. As illustrated, each plate cylinder in the present embodiment is equipped with a single gripper for mounting a single plate divided into two separate color segments. Each plate cylinder will be provided with two separate sets of color rolls. Thus, cylinder 1 is provided with the color rolls 12 and 13 and the plate cylinder 2 is provided with the color rolls 14 and 16.

The various cylinders and rolls to be described are shown schematically for the purpose of :simplicity of illustration and it will be understood, of course, that the cylinders and rolls will be journaled in bearings and connected in a well known manner with the necessary power operated driving mechanisms. In this respect, each of the plate cylinders and blanket cylinders will be provided with conventional eccentric bearings as illustrated at 17 and 18 for the plate cylinders 1 and 2 respectively and at 19 and 21 for the blanket cylinders 3 and 4 respectively. These eccentric bearing mountings enable the cylinders to be moved off and on impression selectively in a manner well known in the prior art.

Referring to the plate cylinder 1, it will be seen that the single plate is divided into two segments 22 and 23. The plate may be of a conventional design, usually formed with an aluminum surface coated with silicone or the like which is etched away by an imaging device to obtain the desired design pattern to which ink is applied by the ink roll systems 12 and 13. This process is well known in the prior art and forms no part of the present invention. By way of example, the segment 22 will have magenta ink applied by means of the form rollers 12 and the segment 23 will have cyan ink applied by means of the form rollers 13. As previously mentioned, the preferred embodiment utilizes a single plate divided into two color segments rather than individual plates with separate gripping mechanisms. With only one gripping mechanism, proper registration between the colors is insured. In order to attain accurate registration between the colors of the two plate cylinders, at least one cylinder will be circumferentially and laterally adjustable relative to the other plate cylinder.

Shown schematically, the form rollers are moved in and out of registration with the plate cylinder 1 by means of the two form roller cams 24 and 26 respectively. This mechanism and process for ink roller application is well understood to those skilled in the art. It will also be noted that, for purposes of illustration, the present system utilizes waterless image plates but the present system would function equally well with inking systems which utilize dampeners. It will be understood of course that the roller cams will operate to bring the proper color ink rollers into registry with the appropriate plate segment and to lift the rollers out of contact with the other plate segment as the cylinder rotates. The plate cylinder 2, except for the color combinations indicated, is substantially identical to the plate cylinder 1 as just described. The cylinder 2 is provided with a single plate having segments 27 and 28 which are brought into engagement with the color rolls 14 and 16 alternately to provide the yellow and black color design surfaces as shown by way of illustration. The color rolls are operated by means of the roller cams 29 and 31 as previously described.

The offset blanket cylinders 3 and 4 as aforementioned are provided with eccentric bearings 19 and 21 respectively which allow the cylinders to be moved on and off impression with the cylinder 6. The blanket cylinders 3 and 4 are of the same diameter as plate cylinders 1 and 2 and each blanket cylinder is segmented so as to include two separate blankets which are of the same circumferential length as the individual segments of the plates of cylinders 1 and 2 previously described. The blanket cylinder 3 has a first blanket 32 and a second blanket 33 which are in registry with and cooperate respectively with the plate segments 27 and 28 respectively of the plate cylinder 2. The segments of the plate cylinders 1 and 2 thus serve to transfer the four respective color designs to the associated segments of the blanket cylinder.

The impression cylinder 6 is larger in diameter than the plate and blanket cylinders and is divided into three segments a–c, with each segment having a circumferential length equal to one half the circumference of the blanket cylinders.

As described thus far, the system relates to a four-color printing systems. In order to increase the number of colors to be printed it is possible to simply increase the number of color segments on the plate and blanket cylinders. Likewise it would be possible to add additional sets of plate and blanket cylinder combinations with the same number of segments as illustrated. In any event, the impression cylinder 6 will be chosen of such a diameter as to include a number of segments equal to the number of segments on any one blanket cylinder multiplied by a whole number, plus one additional segment. Thus there always remains one additional blank segment for the infeed of sheets to be printed as will be described.

As illustrated in FIG. 1 sheets are fed from the stack 37 by means of the sheet feeder conveyor 8 which introduces the incoming sheets to the transfer drum 9 which feeds the sheet to the gripper mechanism of one of the segments of the impression cylinder 6 in a well known manner. As will be presently understood, the sheet feeding mechanism in the illustrated four color press embodiment will be controlled to feed a sheet to alternate segments of the rotating impression drum 6. Likewise, the sheets are removed from the impression cylinder segments in alternate fashion by the delivery system 11 and deposited on the stack 38. With this arrangement, each sheet which is picked up by the gripper mechanism of alternate segments of the impression cylinder remains on the surface of the cylinder throughout two full rotations, i.e. until both colors of each blanket cylinder are printed. During the first rotation, the sheet will pick up one color from each blanket cylinder and the other two colors will be picked up during the second rotation of the impression cylinder. At the end of the second rotation, the sheet is removed by the delivery system 11 and stacked. During the initial rotation of the impression cylinder, both of the blanket cylinders may be lifted off impression during the passage of the single blank segment of the impression cylinder by means of the eccentric bearings 19 and 21 as previously described. Alternately the blanket cylinders may be held off impression for the initial rotation and then placed against the impression cylinder during the second rotation when all segments are supplied with paper.

Referring to FIGS. 2–8, the cycling of a single sheet is illustrated during the application of four color design to the sheet. In FIGS. 2–8, the segments of the impression cylinder 6 have been indicated as a, b and c segments. The plate cylinders 1 and 2 and blanket cylinders 3 and 4 have been labeled to indicate the colors which are to be applied by each segment and correspond to the colors illustrated for the plate and blanket cylinder segments in FIG. 1. As shown in FIG. 2, a sheet 39 to be printed is initially picked up by the gripper mechanism of segment a of the impression cylinder and, as seen in FIG. 3, is printed with the black segment B of blanket 3 and subsequently receives the magenta color M from blanket 4. It will also be noted that, during this movement of segment a, the sheet feed mechanism has skipped segment b leaving it blank or empty. The blankets 3 and 4 have been taken off impression and do not contact segment b. As shown in FIG. 4, a second sheet 41 is fed to the gripper mechanism of segment c which proceeds to be printed with black and magenta as shown in FIG. 5 and segment a is skipped by the sheet feeder. The sheet 39 on segment a proceeds to be printed the second time with the colors, yellow Y and cyan C. As shown in FIG. 6, segment b is next provided with a sheet 42 and, as shown in FIG. 7,no sheet is fed to segment c and the sheet 39 is released to the delivery mechanism 11 to be stacked as shown in FIG. 8. FIG. 8 shows a third sheet 43 being fed onto the gripper mechanism of the segment a as it proceeds. This process is then repeated with the sheet feeder mechanism feeding every other segment and the delivery system 11 removing every other printed sheet with four colors thereon.

While the present embodiment has been described with reference to a 4-color printing system, as aforementioned, the color printing capacity may be expanded within certain limits by either increasing the number of segments on the plate and blanket cylinders or by providing additional plate and blanket cylinder combinations. If the number of color segments on the blanket cylinders is increased, the number of segments on the impression cylinder 6 will be correspondingly increased according to the relationship previously described. The number of revolutions required for multi-color printing of a single sheet will also be increased accordingly as previously described, i.e. each sheet will be carried a number of rotations equal to the number of colors on any one blanket cylinder. Once the sheet has been printed with all colors it is removed by the delivery system and another sheet is fed to the empty segment.

It may be seen that the printing system of the present invention provides significant improvements in the cost and efficiency of multi-color offset printing systems, for instance the present embodiment described enables 4-color printing with the use of only five printing cylinders. With the segmented impression cylinder and alternate sheet feed and delivery combined with the direct registry of multiple segmented plate and blanket cylinders, the speed with which multi-color printing is accomplished is greatly increased. For instance, in the present embodiment the sheet may be carried on the impression cylinder during only two rotations to obtain four colors. Similarly a 6-color printing system would require only three rotations of the sheet to pick up six colors.

The present invention has been described with reference to a preferred embodiment. Modifications and alterations may become apparent to one skilled in the art upon reading and understanding of this specification. It is intended to include all such modifications and alterations within the scope of the appended claims.

What is claimed is:

1. In a printing press, the combination comprising;

a rotary impression cylinder having a plurality of circumferential segments, each said segments being provided with means to grip a single sheet for printing, at least one rotary printing cylinder mounted and arranged for printing contact with said impression cylinder, said printing cylinder having a plurality of circumferential printing segments of the same length as the impression cylinder segments and arranged to successively register in printing contact therewith during rotation of said cylinders, the circumference of said impression cylinder being greater than that of said printing cylinder by at least the length of one said segment, whereby multiple designs may be successively printed on each sheet carried for successive revolutions of said impression cylinder.

2. The combination of claim 1 wherein;

the number of segments on said impression cylinder is equal to the number of segments on said printing cylinder multiplied by a whole number, plus one additional segment.

3. The combination of claim 2 including a plurality of said printing cylinders arranged about the periphery of said impression cylinder, each said printing cylinder being of equal diameter and having the same number of segments thereon.

4. In a printing press the combination comprising;

a multiple segmented impression cylinder, a multiple segmented printing cylinder for printing contact therewith, and gripper means to hold a sheet to be printed on each segment of said impression cylinder for a number of revolutions equal to the number of segments on said printing cylinder, whereby multiple designs may be successively printed on each said sheet with a single gripping on said impression cylinder.

5. The combination of claim 4 wherein;

the number of segments on said impression cylinder is equal to the number of segments on said printing cylinder multiplied by a whole number, plus one additional segment.

6. The combination according to claim 5 including;

means to apply different colored printing medium to each segment of said printing cylinder.

7. The combination according to claim 6 including;

means to selectively move said printing cylinder off and on printing contact with said impression cylinder to permit at least one initial revolution of said impression cylinder prior to printing successive sheets.

8. The combination of claim 6 including;

delivery means operatively associated with said impression cylinder for removing printed sheets from successive segments thereof during rotation following the printing of all segments of said printing cylinder.

9. The combination of claim 6 wherein said printing cylinder comprises a blanket transfer cylinder and said means to apply different color printing medium comprises;

a multiple segmented plate cylinder of equal diameter and having the same number of segments as said blanket cylinder, and means for applying a different color to each segment of said plate cylinder.

10. The combination of claim 4 including a plurality of said printing cylinders arranged about the periphery of said impression cylinder, each said printing cylinders being of equal diameter and having the same number of segments thereon.

11. The combination of claim 10 including;

means to apply a different color printing medium to each individual segment of said plurality of printing cylinders.

12. The combination of claim 9 including a plurality of said blanket cylinders and associated plate cylinders arranged about the periphery of said impression cylinder, said blanket cylinders being of equal diameter and having the same number of segments thereon.

13. In a printing press, the combination comprising;

a rotary impression cylinder having a plurality of circumferential segments, each said segments being provided with gripper means to grip a single sheet for printing, at least one rotary blanket cylinder mounted and arranged for printing contact with said impression cylinder, said blanket cylinder having a plurality of circumferential blanket segments of the same length as the impression cylinder segments and arranged to successively register in printing contact therewith during rotation of said cylinders, and a segmented rotary plate cylinder carrying different designs on the segments thereof mounted and arranged for contact with said blanket cylinder, said plate cylinder being of equal diameter with the blanket cylinder and having the same number of segments for successive registry therewith during rotation, whereby multiple designs may be successively printed on each sheet carried by each segment of said impression cylinder.

14. The combination of claim 13 wherein;

the number of segments on said impression cylinder is equal to the number of segments on said blanket cylinder multiplied by a whole number, plus one additional segment, said gripper means holding each sheet on said impression cylinder for a number of revolutions thereof equal to the number segments on said blanket cylinder.

15. In a multi-color printing press, the combination comprising;

a rotary impression cylinder having a plurality of circumferential segments, each said segments being provided with gripping means to grip a single sheet for printing, a plurality of rotary blanket cylinders mounted and arranged about the periphery of said impression cylinder for movement off and on printing contact with said impression cylinder, said blanket cylinders being equal in diameter and having an equal number of circumferential blanket segments of the same length as the impression cylinder segments and arranged to successively register in printing contact therewith during rotation of said cylinders, the number of segments on said impression cylinder being equal to the number of segments on each blanket cylinder multiplied by a whole number, plus one additional segment, and said gripping means holding a sheet to be printed on each segment of said impression cylinder for a number of revolutions equal to the number of segments on one of said blanket cylinders, a plurality of segmented rotary plate cylinders mounted and arranged for movement off and on contact with respective ones of said blanket cylinders, said plate cylinders being of equal diameter as the associated blanket cylinder and having the same number of segments thereof arranged to successively register therewith during rotation, means for applying a different color printing medium to each segment of said plate cylinders, sheet feeding means for feeding sheets to be printed to the gripping means of successive segments of said impression cylinder during rotation, and delivery means operatively associated with said gripping means for removing printed sheets from successive segments of said impression cylinder during rotation following the printing of all segments of said blanket cylinders, whereby multiple colors may be successively printed on each sheet with a single gripping on said impression cylinder.

16. A method of printing multiple designs on a single sheet comprising the steps of;

repeatedly applying a plurality of color designs from multiple segments on a single rotary plate cylinder onto a corresponding number of blanket segments of equal length on a rotary blanket cylinder of equal diameter, transferring said color designs from each said blanket segment onto successive sheets held by segments of a rotating impression cylinder, the number of segments on said impression cylinder being equal to the number of segments on said blanket cylinder multiplied by a whole number, plus one additional segment, and carrying each said sheet on the surface of said impression cylinder for a number of revolutions thereof equal to the number of segments on the blanket cylinder, whereby successive sheets carried by the impression cylinder will be printed with successive color designs from said blanket cylinder.

17. The method according to claim 16 wherein a plurality of said plate and blanket cylinder combinations are located about the periphery of a single segmented impression cylinder, the diameter of said plate and blanket cylinders and the number of segments thereon are equal, and including the step of;

carrying each said sheets by said impression cylinder for a number of revolutions thereof equal to the number of segments on any one of said blanket cylinders.

18. The method according to claim 17 including the step of;

feeding and delivering sheets to and from alternate successive segments of said impression cylinder.

* * * * *